US011932362B2

(12) United States Patent
Yu

(10) Patent No.: US 11,932,362 B2
(45) Date of Patent: Mar. 19, 2024

(54) HEAT GENERATION DIVING SUIT

(71) Applicant: EVERWELL TECHNOLOGY CO., LTD, Daejeon (KR)

(72) Inventor: Su Nam Yu, Daejeon (KR)

(73) Assignee: EVERWELL TECHNOLOGY CO., LTD, Daejeon (KR)

( * ) Notice: Subject to any disclaimer, the term of this patent is extended or adjusted under 35 U.S.C. 154(b) by 0 days.

(21) Appl. No.: 17/898,369

(22) Filed: Aug. 29, 2022

(65) Prior Publication Data

US 2023/0083311 A1 Mar. 16, 2023

(30) Foreign Application Priority Data

Sep. 16, 2021 (KR) ..... 10-2021-0123676

(51) Int. Cl.

| | |
|---|---|
| ***B63C 11/08*** | (2006.01) |
| ***B63C 11/04*** | (2006.01) |
| ***B63C 11/26*** | (2006.01) |
| ***B63C 11/28*** | (2006.01) |

(52) U.S. Cl.

CPC ..... *B63C 11/28* (2013.01); *B63C 11/04* (2013.01); *B63C 11/26* (2013.01)

(58) Field of Classification Search

CPC ..... A41D 13/0051; A41D 13/005; A41D 13/0125; A41D 13/02; A41D 1/002; A41D 27/02; B63C 11/28; B63C 2011/043; B63C 11/08; B63C 11/04; B63C 11/26; H05B 1/0272; H05B 3/145; H05B 3/34; H05B 2214/04; H05B 2203/036; D10B 2501/00; B32B 9/045; B32B 9/007; B32B 3/266; B32B 5/024; B32B 7/12; B32B 5/06; B32B 9/047; B32B 2255/02; B32B 2605/08; B32B 2260/021; B32B 2535/00; B32B 2605/003; B32B 2255/26; B32B 2260/046; B32B 2601/00; B32B 2437/00; B32B 2571/00; B32B 2260/023; B32B 2307/30; F16L 59/029

See application file for complete search history.

(56) References Cited

U.S. PATENT DOCUMENTS

| | | | | |
|---|---|---|---|---|
| 3,599,625 | A * | 8/1971 | Curtis | C09K 5/16 126/14 |
| 9,963,210 | B1 * | 5/2018 | Ebot | A41D 13/0051 |
| 10,912,977 | B1 * | 2/2021 | Fuller | A63B 69/125 |
| 2002/0146948 | A1 * | 10/2002 | Pillai | A41D 13/0051 441/106 |
| 2009/0114632 | A1 * | 5/2009 | Shiue | B63C 9/087 219/211 |

(Continued)

*Primary Examiner* — Edwin J Toledo-Duran
(74) *Attorney, Agent, or Firm* — Rabin & Berdo, P.C.

(57) ABSTRACT

A heat generation diving suit according to an embodiment of the present invention includes: a clothes unit made of a material having a waterproof function, and configured to cover at least a part of a user's body; a power transmission unit having a waterproof function, and configured to wirelessly transmit power of a battery unit; a power reception unit provided in the clothes unit, and configured to have a waterproof function, attach and detach the power transmission unit, and receive power wirelessly transmitted from the power transmission unit; and a heat generation unit configured to emit heat using the power supplied from the power reception unit.

7 Claims, 6 Drawing Sheets

(56) References Cited

U.S. PATENT DOCUMENTS

| | | | | |
|---|---|---|---|---|
| 2009/0289046 | A1* | 11/2009 | Richmond | A41D 13/0051 429/61 |
| 2011/0220634 | A1* | 9/2011 | Yeh | A43B 3/34 219/482 |
| 2012/0213034 | A1* | 8/2012 | Imran | H04B 11/00 367/132 |
| 2013/0116512 | A1* | 5/2013 | Imran | A61B 5/6803 600/301 |
| 2013/0121113 | A1* | 5/2013 | Imran | H04B 13/005 367/132 |
| 2017/0332442 | A1* | 11/2017 | Strecker | H05B 1/0272 |
| 2018/0103694 | A1* | 4/2018 | Fortenbacher | A41D 13/0051 |
| 2018/0169994 | A1* | 6/2018 | Burwell | B32B 9/045 |
| 2018/0332908 | A1* | 11/2018 | Quaglia | B32B 25/16 |
| 2019/0175992 | A1* | 6/2019 | Park | B63C 11/46 |
| 2022/0160540 | A1* | 5/2022 | Wang | A61F 7/08 |
| 2022/0410369 | A1* | 12/2022 | Samlali | B25J 9/142 |

* cited by examiner

HEAT GENERATION DIVING SUIT

BACKGROUND OF THE INVENTION

Field of the Invention

The present invention relates to a heat generation diving suit.

Background of the Related Art

Due to increase in the leisure activities worldwide, the number of people enjoying activities on the water or in the water is increasing.

Unlike the activities on the ground, it may be relatively difficult to maintain body temperature of a user in the water or on the water.

Accordingly, researches for maintaining the body temperature of a user in the water or on the water are being conducted.

SUMMARY OF THE INVENTION

An object of the present invention is to provide a heat generation diving suit capable of emitting heat through a heat generation unit without deterioration of the waterproof function.

The task of the present application is not limited to the task mentioned above, and unmentioned other tasks will be clearly understood by those skilled in the art from the following description.

To accomplish the above object, according to one aspect of the present invention, there is provided a heat generation diving suit comprising: a clothes unit made of a material having a waterproof function, and configured to cover at least a part of a user's body; a power transmission unit having a waterproof function, and configured to wirelessly transmit power of a battery unit; a power reception unit provided in the clothes unit, and configured to have a waterproof function, attach and detach the power transmission unit, and receive power wirelessly transmitted from the power transmission unit; and a heat generation unit configured to emit heat using the power supplied from the power reception unit.

The power transmission unit and the power reception unit may include a power transmission coil unit and a power reception coil unit, respectively, wherein the power transmission coil unit includes a power transmission coil and a transmission insulating base unit provided with the power transmission coil, and the power reception coil unit includes a power reception coil and a reception insulating base unit provided with the power reception coil, wherein the transmission insulating base unit includes a plurality of transmission magnets, and positive and negative electrodes of the plurality of transmission magnets are arranged according to a first pattern, and the reception insulating base unit includes a plurality of reception magnets, and positive and negative electrodes of the plurality of reception magnets are arranged according to a second pattern corresponding to the first pattern.

When the positive electrodes of the plurality of transmission magnets according to the first pattern and the negative electrodes of the plurality of reception magnets according to the second pattern are attached to each other, and the negative electrodes of the plurality of transmission magnets according to the first pattern and the positive electrodes of the plurality of reception magnets according to the second pattern are attached to each other, the power transmission coil and the power reception coil may be aligned.

The battery unit may include: a housing unit into which a battery may be inserted; a battery holder provided with a battery hole into which the battery may be inserted, capable of being inserted into and removed from the housing unit, and separating the battery from an inner surface of the housing unit; a battery management system (BMS) circuit unit connected to the battery through a conductive wire to manage charge and discharge of the battery; and a waterproof housing cover provided with a waterproof connector that electrically connects the BMS circuit unit and the wireless power transmission unit, and covering an opening area of the housing unit.

The diving suit according one aspect of the present invention may further comprise: a sensing unit, i.e., a wearable device that can be worn on a user's body, including a sensing battery, and transmitting user's swimming information in an ultrasound form; and an information transmission unit electrically connected to the power transmission unit to receive power for operation and to transmit the swimming information transmitted from the sensing unit toward an information reception unit floating on the surface of water in an ultrasonic wave form.

The information reception unit may include: an information reception module located in the water to convert the swimming information of an ultrasonic wave form received from the information transmission unit into an electrical signal and transmit the electrical signal; an antenna located on the water to transmit the swimming information into the air; and a buoyancy body connected to the information reception module and the antenna to provide buoyancy.

The information reception unit may transmit the swimming information of an electrical signal form, together with location information of the information reception unit, and the antenna may transmit the swimming information and the location information into the air.

The heat generation diving suit of the present invention may emit heat through a heat generation unit without deterioration of the waterproof function through a power transmission unit and a power reception unit.

The effects of the present application are not limited to the effects mentioned above, and unmentioned other effects will be clearly understood by those skilled in the art from the following description.

DETAILED DESCRIPTION OF THE PREFERRED EMBODIMENT

Hereinafter, an embodiment of the present invention will be described in detail with reference to the accompanying drawings. However, the accompanying drawings are described only to disclose the contents of the present invention more easily, and those skilled in the art may easily understand that the scope of the present invention is not limited to the scope of the accompanying drawings.

In addition, the terms used in this application are only used to describe a specific embodiment, and are not intended to limit the present invention. Singular expressions include plural expressions unless the context clearly dictates otherwise.

It should be understood that in this application, the terms such as "comprise" or "have" are intended to designate presence of a feature, a number, a step, an operation, a component, a part, or a combination of these described in the specification, not to preclude the possibility of addition or presence of one or more other features, numbers, steps, operations, components, parts, or combinations of these.

Figure 1:
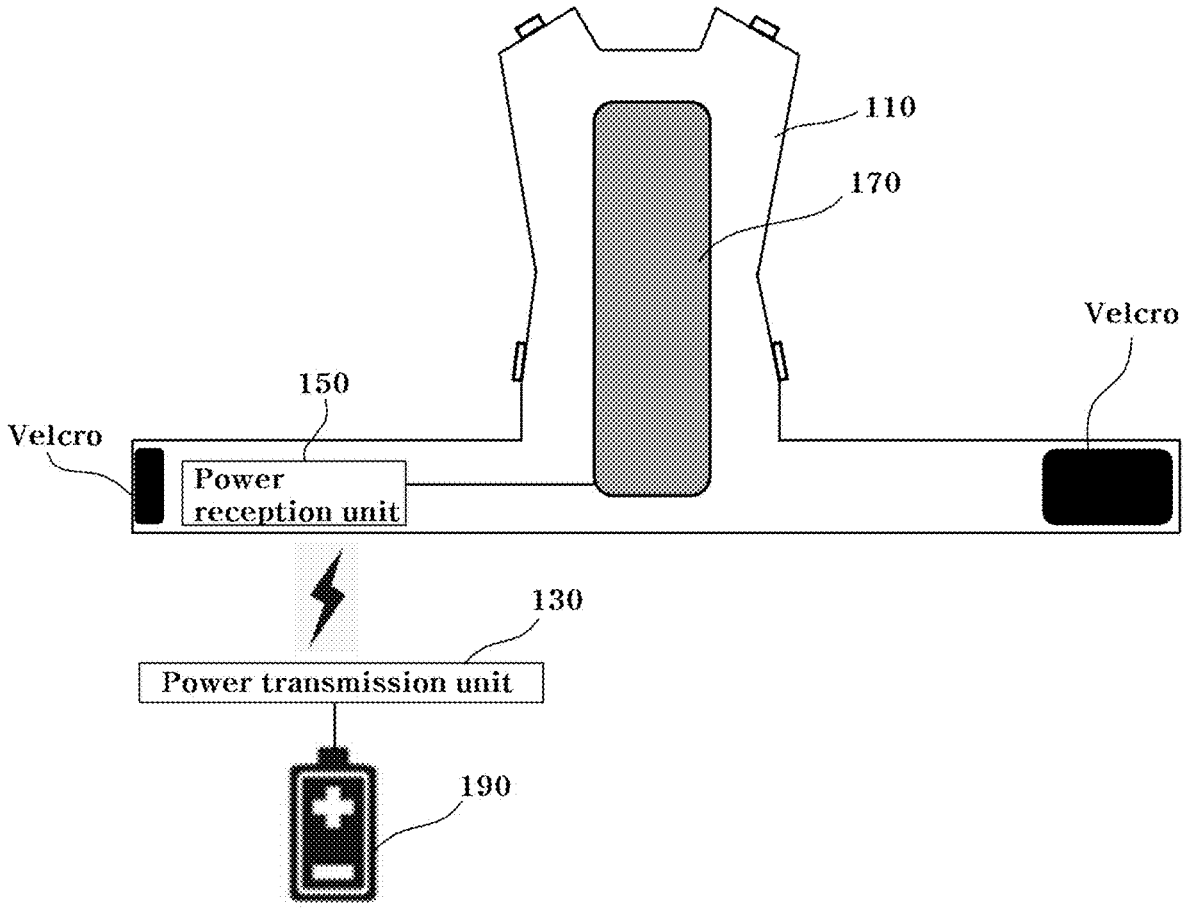
FIG. 1 is a view showing a heat generation diving suit according to embodiments of the present invention.

FIG. 1 is a view showing a heat generation diving suit according to an embodiment of the present invention. As shown in FIG. 1, the heat generation diving suit according to an embodiment of the present invention includes a clothes unit 110, a power transmission unit 130, a power reception unit 150, and a heat generation unit 170.

The clothes unit 110 is made of a material having a waterproof function and is configured to cover at least a part of a user's body. The clothes unit 110 may include one or more layers of waterproof material, or a textile material may be provided on the waterproof material to improve user's sense of touch.

The configuration of the clothes unit 110 described above is only an example and is not limited thereto. The shape of the clothes unit 110 in FIG. 1 is only an example and is not limited thereto. Although the clothes unit 110 may be provided with Velcro or a strap for maintaining a state worn on the user's body, it is not limited thereto.

The power transmission unit 130 has a waterproof function and is configured to wirelessly transmit power of the battery unit 190. The power transmission unit 130 may be connected to the battery unit 190 by a waterproof cable. The waterproof cable may be connected to a waterproof connector 1951 provided in the battery unit 190. The battery unit 190 and the power transmission unit 130 may have a structure that can be connected to and disconnected from each other. Accordingly, a user may replace the battery unit 190 when discharge efficiency of the battery unit 190 is reduced or the battery unit 190 is damaged.

The contact point between the waterproof cable and the power transmission unit 130 may also be sealed with a waterproof material. The waterproof structures of the power transmission unit 130 and the battery unit 190 will be described below in detail.

The power reception unit 150 is provided in the clothes unit 110, and is configured to have a waterproof function, attach and detach the power transmission unit 130, and receive power wirelessly transmitted from the power transmission unit 130. The power reception unit 150 may wirelessly receive power from the power transmission unit 130 by electromagnetic induction with the power transmission unit 130.

Figure 2:
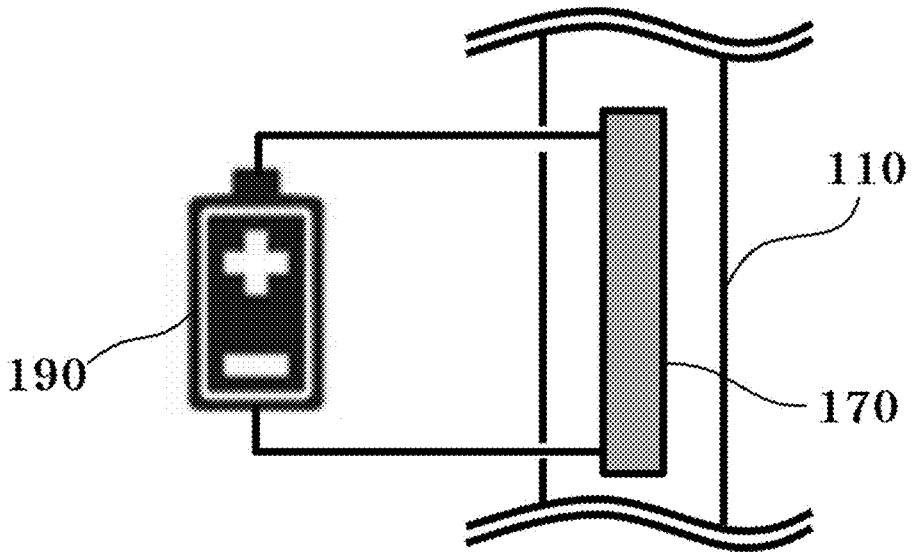
FIG. 2 is a view showing connection between a heat generation unit and a battery unit by a conductive wire.

As shown in FIG. 2, when the heat generation unit 170 and the battery unit 190 are connected through a conductive wire unlike the present invention, a hole for the conductive wire may be formed in the clothes unit 110 surrounding the heat generation unit 170. The hole drilled in the clothes unit 110 like this may lower the waterproof performance. Accordingly, when the user performs an activity in the water, a safety accident such as a short circuit may occur in the heat generation unit 170.

Figure 3:
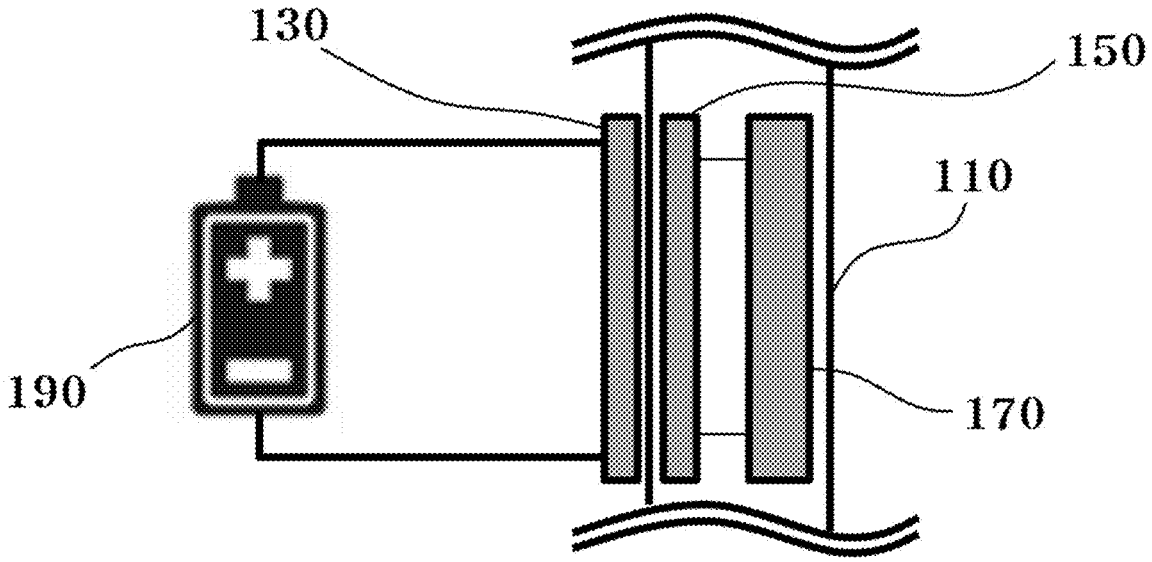
FIG. 3 is a view showing wireless power transmission and reception in a heat generation diving suit according to an embodiment of the present invention.

In comparison thereto, since power is wirelessly transmitted to the heat generation unit 170 through the power transmission unit 130 and the power reception unit 150 as shown in FIG. 3 in the present invention, the waterproof performance may be maintained since no hole is drilled in the clothes unit.

The heat generation unit 170 is configured to emit heat by using the power supplied from the power reception unit 150. The heat generation unit 170 may include a temperature control unit (not shown) and a power cutoff unit (not shown). The temperature control unit may control temperature of the heat generation unit 170 by adjusting the power supplied to the heat generation unit 170. The power cutoff unit may cut off the power supplied to the heat generation unit 170 when the temperature of the heat generation unit 170 rises excessively. For example, although the power cutoff unit may cut off power through a bimetal, this is only an example, and the present invention is not limited thereto.

The heat generation unit 170 may be implemented using various materials capable of generating heat as power is supplied. The heat generation unit 170 may be covered with a waterproof cover that provides a waterproof function or coated with a waterproof material such as thermoplastic polyurethane (TPU) as much as a thickness set in advance. The present invention is not limited to such a waterproof material.

Figure 4:
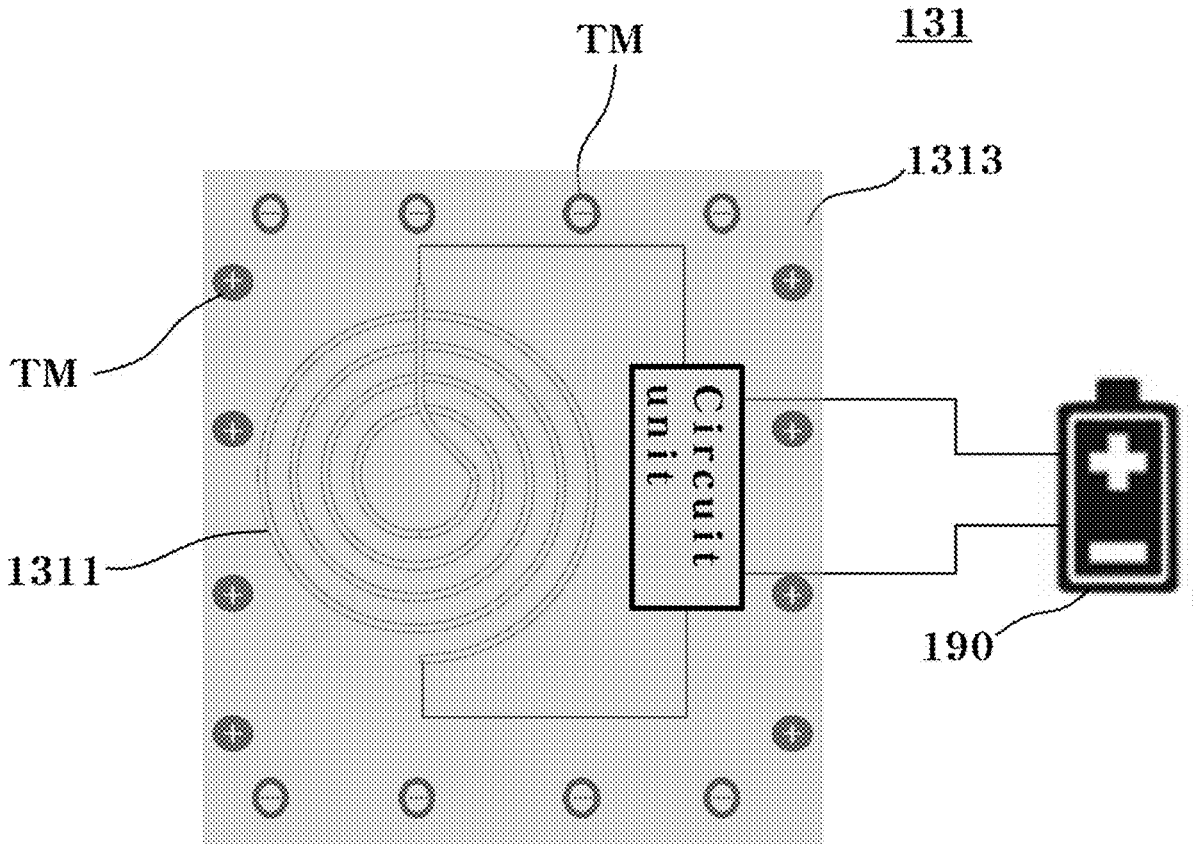
FIGS. 4 and 5 are views showing an example of the structures of a power reception unit and a power transmission unit, respectively.
Figure 5:
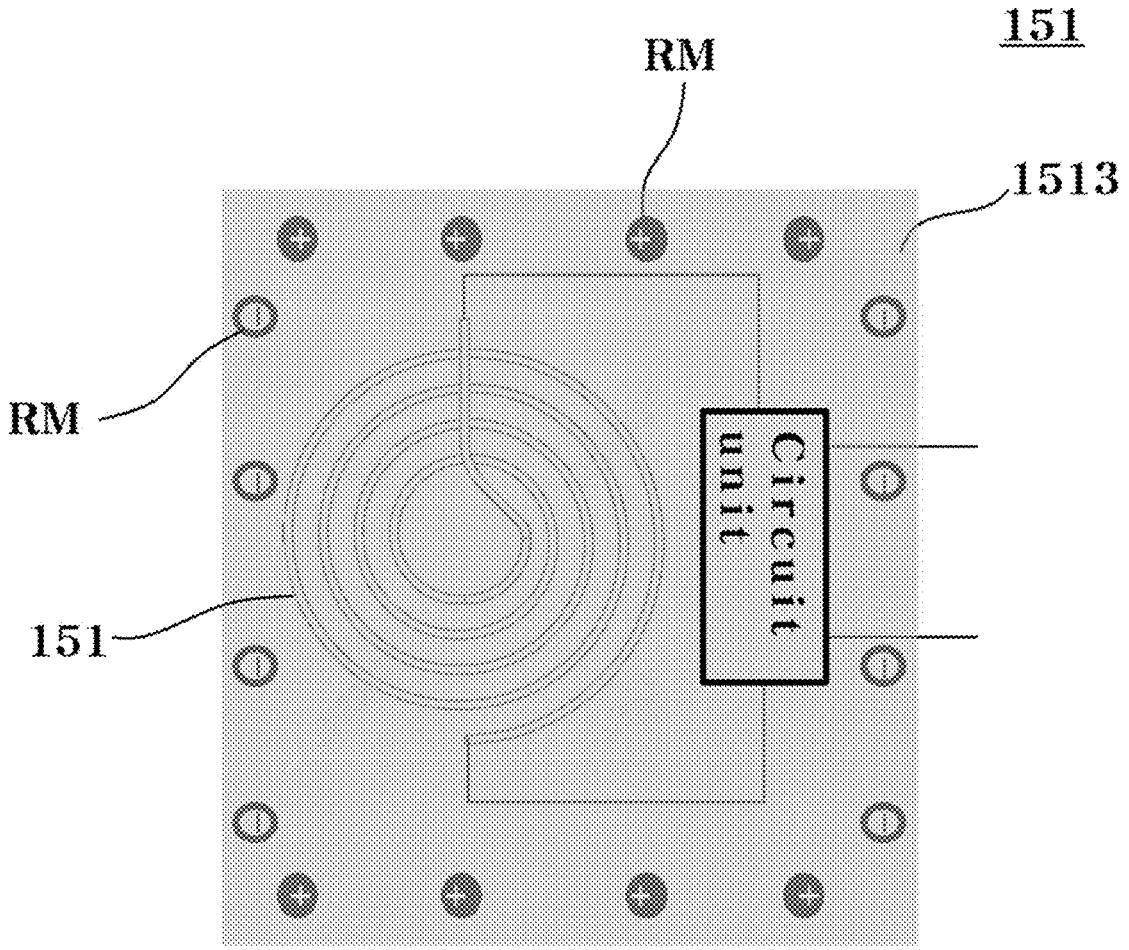

Meanwhile, the power transmission unit 130 and the power reception unit 150 may include a power transmission coil unit 131 and a power reception coil unit 151, respectively. FIGS. 4 and 5 are views showing an example of the structures of the power reception unit 150 and the power transmission unit 130, respectively.

The power transmission coil unit 131 may include a power transmission coil 1311 and a transmission insulating base unit 1313 provided with the power transmission coil 1311. In addition, the power reception coil unit 151 may include a power reception coil 1511 and a reception insulating base unit 1513 provided with the power reception coil 1511.

The transmission insulating base unit 1313 and the reception insulating base unit 1513 may be made of a material capable of sealing the power transmission coil 1311 and the power reception coil 1511 by providing insulation and waterproof properties, and providing a fixing force as much as not to drop off a transmission magnet (TM) and a reception magnet (RM) described below.

For example, although the transmission insulating base unit 1313 and the reception insulating base unit 1513 may be made of polycarbonate, it is not limited thereto.

At this point, the transmission magnet (TM) and the reception magnet (RM) are for positioning the power transmission unit 130 and the power reception unit 150 in the right positions. Instead of the transmission magnet (TM) and the reception magnet (RM), Velcro or a button unit may be provided.

The transmission insulating base unit 1313 may include a plurality of transmission magnets (TM), and positive and negative electrodes of the plurality of transmission magnets (TM) may be arranged according to a first pattern. In addition, the reception insulating base unit 1513 may include a plurality of reception magnets (RM), and positive and negative electrodes of the plurality of reception magnets (RM) may be arranged according to a second pattern corresponding to the first pattern.

For example, as shown in FIG. 4, the transmission magnets (TM) may be arranged on the top, left, bottom, and right sides of the transmission insulating base unit 1313, respectively, in the first pattern of negative electrodes of the transmission magnet (TM), positive electrodes of the transmission magnet (TM), negative electrodes of the transmission magnet (TM), and positive electrodes of the transmission magnet (TM).

As shown in FIG. 5, the reception magnets (RM) may be arranged on the top, left, bottom, and right sides of the reception insulating base unit 1513, respectively, in the second pattern of positive electrodes of the reception magnet (RM), negative electrodes of the reception magnet (RM), positive electrodes of the reception magnet (RM), and negative electrodes of the reception magnet (RM).

The first pattern and the second pattern of FIGS. 4 and 5 are only examples, and the present invention is not limited to the first pattern and the second pattern of FIGS. 4 and 5.

Accordingly, the positive electrodes of the plurality of transmission magnets (TM) according to the first pattern and the negative electrodes of the plurality of reception magnets (RM) according to the second pattern may be attached to each other, and the negative electrodes of the plurality of transmission magnets (TM) according to the first pattern and the positive electrodes of the plurality of reception magnets (RM) according to the second pattern may be attached to each other.

In this case, the power transmission coil 1311 and the power reception coil 1511 may be aligned. Accordingly, power may be efficiently transferred from the power transmission coil 1311 to the power reception coil 1511.

In the case of wireless power transmission and reception, the efficiency of power transmission and reception may vary according to arrangement of the power transmission coil 1311 and the power reception coil 1511. In the present invention, when the transmission magnets (TM) and the reception magnets (RM) are attached to each other by magnetic force, the power transmission coil 1311 and the power reception coil 1511 be stably aligned to enhance the efficiency of wireless power transmission and reception.

When a user is in the water, the user may feel discomfort while moving, so that it may be difficult to properly arrange the power transmission coil 1311 and the power reception coil 1511. In the case of the present invention, since the transmission magnets (TM) and the reception magnets (RM) are arranged according to the first pattern and the second pattern corresponding to each other, the user may stably align the power transmission coil 1311 and the power reception coil 1511 in the water.

Although a DC-DC converter for converting the voltage of the battery unit 190 into a preset voltage, an overcurrent circuit breaker, an LED driver, and the like may be implemented in the circuit unit of FIG. 4, the present invention is not limited thereto. In addition, although the temperature control unit and the power cutoff unit described above may be implemented in the circuit unit of FIG. 5, the present invention is not limited thereto.

Instead of the transmission magnets (TM) and the reception magnets (RM), Velcro or button units may be arranged according to the first pattern and the second pattern. Hooks and loops of the Velcro may be arranged on the transmission insulating base unit according to the first pattern, and hooks and loops of the Velcro may be arranged on the reception insulating base unit according to the second pattern.

In addition, female and male parts of the button units may be arranged on the transmission insulating base unit according to the first pattern, and the female and male parts of the button unit may be arranged on the reception insulating base unit according to the second pattern.

For example, the hooks of the Velcro or the female part of a button unit may be provided instead of the positive magnet of FIG. 4, and the loops of the Velcro or the male part of a button unit may be provided instead of the negative magnet of FIG. 4. In correspondence thereto, the loops of the Velcro or the male part of the button unit may be provided instead of the negative magnet of FIG. 5, and the hooks of the Velcro or the female part of the button unit may be provided instead of the positive magnet of FIG. 5.

Figure 6:
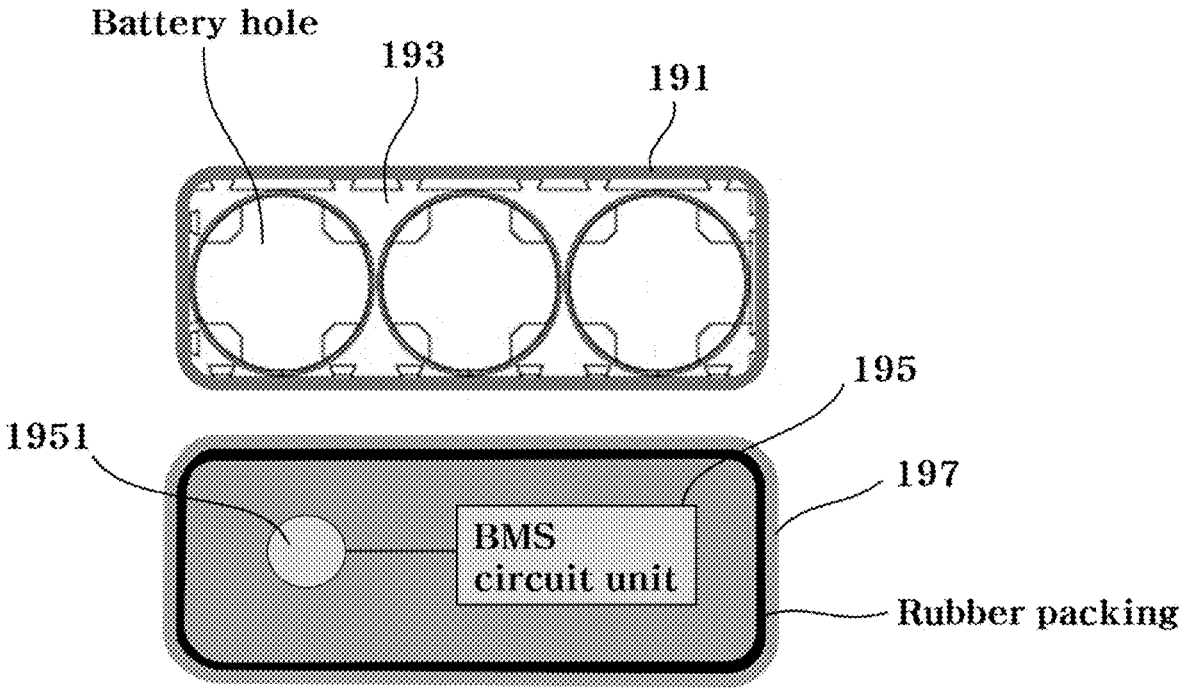
FIG. 6 is a view showing an example of a battery unit.

Meanwhile, as shown in FIG. 6, the battery unit 190 may include a housing unit 191, a battery holder 193, a battery management system (BMS) circuit unit 195, and a waterproof housing cover 197.

A battery may be inserted in the housing unit 191. The housing unit 191 may be made of a metal (e.g., aluminum) that is less corrosive even when it contacts with water, or the surface thereof may be coated with the metal. The housing unit 191 may be made of a plastic material robust to corrosion and may provide insulation and waterproof properties.

The battery holder 193 is provided with a battery hole into which a battery may be inserted, may be inserted into and removed from the housing unit, and may separate the battery from the inner surface of the housing unit 191. The battery holder 193 may be made of a material (e.g., plastic) that provides insulation and shock absorption properties. Accordingly, when the housing unit 191 is made of a metal, the battery holder 193 may prevent electrical connection between the battery and the housing unit 191. In addition, the battery holder 193 may protect, together with the housing unit 191, the battery from the shock transferred from the outside.

In FIG. 6, although three circular batteries are inserted into the circular battery holes, the present invention is not limited thereto. For example, the battery holes may be a rectangular shape.

The BMS circuit unit 195 may be connected to the battery through a conductive wire and manage charge and discharge of the battery. Although the BMS circuit unit 195 may perform the functions of preventing overcharge of the battery, checking the charged state of the battery, and blocking overcurrent, it is not limited thereto.

The waterproof housing cover is provided with a waterproof connector 1951 that electrically connects the BMS circuit unit 195 and the wireless power transmission unit 130, and may cover the opening area of the housing unit 191. For example, as shown in FIG. 6, the waterproof housing cover may be provided with a rubber packing. When the waterproof housing cover covers the opening of the housing unit 191, the housing unit 191 and the rubber packing come into contact with each other to prevent water from flowing into the housing unit 191.

Figure 7:
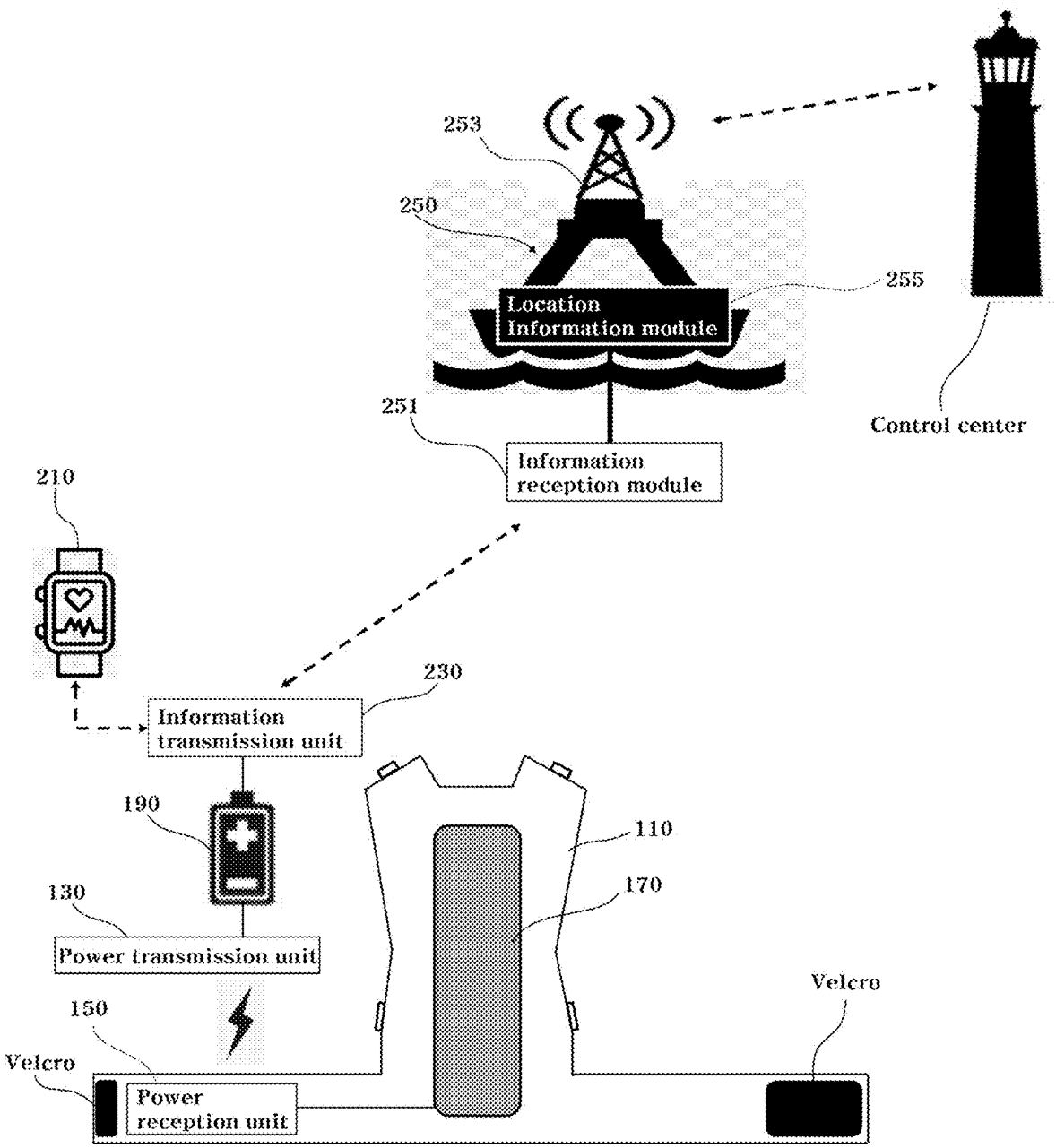
FIG. 7 is a view showing a heat generation diving suit according to embodiments of the present invention.

Meanwhile, as shown in FIG. 7, the heat generation diving suit according to an embodiment of the present invention may further include a sensing unit 210 and an information transmission unit 230.

The sensing unit 210 is a wearable device that can be worn on a user's body (e.g., the wrist or ankle of a user), which includes a sensing battery and may transmit user's swimming information in an ultrasound form. The sensing unit 210 may include a plurality of sensors for sensing the swimming information. The sensing unit 210 may include a controller and a memory for processing sensing information derived by the plurality of sensors.

The controller of the sensing unit 210 may control a process of converting swimming information of an electrical signal form into an ultrasonic signal. Since the user performs an activity in the water, the sensing unit 210 may transmit the swimming information of an ultrasonic wave form so that the swimming information may be transmitted in the water.

The swimming information may include at least one among user's biometric information, swimming environment information, and emergency alarm information.

Although the biometric information may include at least one among the body temperature, pulse, swimming time, and consumed calories of the user, it is not limited thereto.

Although the swimming environment information may include at least one among the depth and temperature in the water where the user is located, it is not limited thereto.

The emergency alarm information corresponds to an emergency situation that occurs while the user is swimming, and may be automatically generated when the user's biometric information is larger or smaller than a reference value and determined as abnormal. Alternatively, the emergency alarm information may be generated by handling a physical button of the sensing unit 210 or handling a touch screen when the user determines that it is an emergency situation.

The information transmission unit 230 is electrically connected to the power transmission unit 130 and receives power for operation, and may transmit the swimming information transmitted from the sensing unit 210 toward an information reception unit 250 floating on the surface of water in an ultrasonic wave form.

Since the sensing unit 210 described above uses a sensing battery, the capacity of the battery may be small for the sensing unit 210 to transmit the swimming information to the information reception unit 250. Accordingly, the sensing unit 210 may transmit the swimming information to the information transmission unit 230 located within a short distance between 2 and 3 meters. Since the information transmission unit 230 receives power from the battery unit 190, it may use power sufficient to transmit the swimming information to the information reception unit 250 located several tens of meters away.

Meanwhile, the information reception unit 250 may include an information reception module 251 located in the water to convert the swimming information of an ultrasonic wave form received from the information transmission unit 230 into an electrical signal and transmit the electrical signal, an antenna 253 located on the water to transmit the converted swimming information into the air, and a buoyancy body 255 connected to the information reception module 251 and the antenna 253 to provide buoyancy.

Since the information transmission unit 230 and the information reception module 251 perform communication in the water, they may transmit and receive swimming information of an ultrasonic wave form. Since the information reception module 251 should communicate with a control center on the ground or on a ship through the antenna 253, it may convert the swimming information of an ultrasonic wave form into swimming information of an electromagnetic wave form.

The buoyancy body 255 may provide buoyancy so that the information reception unit 250 may float on the surface of water.

A user may perform an underwater activity while wearing the heat generation diving suit and the sensing unit 210 of the present invention, and may transmit swimming information to the control center through the information reception unit 250. The information reception unit 250 may be implemented in a light weight and small volume so that the user may float it on the surface of water.

Meanwhile, the information reception unit 250 may transmit the swimming information of an electrical signal form, together with the location information of the information reception unit 250, and the antenna 253 may transmit the swimming information and the location information into the air.

Since the sensing unit 210 and the heat generation diving suit worn on the user may be in the water, it may be difficult to receive location information such as GPS information from the satellites. Since the information reception unit 250 may float on the water by the buoyancy body 255, it may receive the location information from the satellites through a location information module.

Since the heat generation diving suit and the sensing unit 210 worn on the user are located to be apart from the information reception unit 250 up to several tens of meters, the control center may confirm the approximate location of the user through the location information of the information reception unit 250.

Accordingly, since the approximate location of a user may be quickly confirmed in an emergency situation, safety accidents can be prevented.

As described above, the embodiment according to the present invention have been reviewed, and the fact that the present invention can be embodied in other specific forms without departing from the spirit or scope of the present invention, in addition to the embodiment described above, is apparent to those skilled in the art. Therefore, the embodiment described above should be regarded as illustrative rather than restrictive, and accordingly, the present invention is not limited to the above description, but may be modified within the scope of the appended claims and equivalents thereof.

DESCRIPTION OF SYMBOLS

110: Clothes unit
130: Power transmission unit
131: Power transmission coil unit
1311: Power transmission coil
1313: Transmission insulating base unit
150: Power reception unit
151: Power reception coil unit
1511: Power reception coil
1513: Reception insulating base unit
TM: Transmission magnet
RM: Reception magnet
170: Heat generation unit
190: Battery unit
191: Housing unit
193: Battery holder
195: Battery management system (BMS) circuit unit
1951: Waterproof connector
197: Waterproof housing cover
210: Sensing unit
230: Information transmission unit
250: Information reception unit
251: Information reception module
253: Antenna
255: Buoyancy body

What is claimed is:

1. A heat generation diving suit comprising:

a clothes unit made of a material having a waterproof function, and configured to cover at least a part of a user's body;

a power transmission unit having a waterproof function, and configured to wirelessly transmit power of a battery unit;

a power reception unit provided in the clothes unit, and configured to have a waterproof function, attach and detach the power transmission unit, and receive power wirelessly transmitted from the power transmission unit; and a heat generation unit configured to emit heat using the power supplied from the power reception unit, wherein the power transmission unit and the power reception unit include a power transmission coil unit and a power reception coil unit, respectively, wherein the power transmission coil unit includes a power transmission coil and a transmission insulating base unit provided with the power transmission coil, and the power reception coil unit includes a power reception coil and a reception insulating base unit provided with the power reception coil, wherein the transmission insulating base unit includes a plurality of transmission magnets, and positive and negative electrodes of the plurality of transmission magnets are arranged according to a first pattern, and the reception insulating base unit includes a plurality of reception magnets, and positive and negative electrodes of the plurality of reception magnets are arranged according to a second pattern corresponding to the first pattern, and wherein in a plan view the transmission magnets and the reception magnets border the power transmission coil and the power reception coil, respectively, on four sides.

2. The heat generation diving suit according to claim 1, wherein when the positive electrodes of the plurality of transmission magnets according to the first pattern and the negative electrodes of the plurality of reception magnets according to the second pattern are attached to each other, and the negative electrodes of the plurality of transmission magnets according to the first pattern and the positive electrodes of the plurality of reception magnets according to the second pattern are attached to each other, the power transmission coil and the power reception coil are aligned.

3. The heat generation diving suit according to claim 1, wherein the battery unit includes:

a housing unit into which a battery may be inserted;

a battery holder provided with a battery hole into which the battery may be inserted, capable of being inserted into and removed from the housing unit, and separating the battery from an inner surface of the housing unit;

a battery management system (BMS) circuit unit connected to the battery through a conductive wire to manage charge and discharge of the battery; and a waterproof housing cover provided with a waterproof connector that electrically connects the BMS circuit unit and the wireless power transmission unit, and covering an opening area of the housing unit.

4. The heat generation diving suit according to claim 1, further comprising:

a sensing unit which is a wearable device that can be worn on a user's body, including a sensing battery, and transmitting user's swimming information in an ultrasound form; and an information transmission unit electrically connected to the power transmission unit to receive power for operation and to transmit the swimming information transmitted from the sensing unit toward an information reception unit configured to float on a surface of water in an ultrasonic wave form.

5. The heat generation diving suit according to claim 4, wherein the information reception unit includes:

an information reception module configured to be located in the water to convert the swimming information of an ultrasonic wave form received from the information transmission unit into an electrical signal and transmit the electrical signal;

an antenna located on the water to transmit the swimming information into the air; and a buoyancy body connected to the information reception module and the antenna to provide buoyancy.

6. The heat generation diving suit according to claim 5, wherein the information reception unit transmits the swimming information of an electrical signal form, together with location information of the information reception unit, and the antenna transmits the swimming information and the location information into the air.

7. The heat generation diving suit according to claim 1, wherein the transmission insulating base unit includes a plurality of hook-and-loop fasteners or a plurality of button units, and hooks and loops of the plurality of hook-and-loop fasteners are arranged according to a first pattern, or female and male parts of the plurality of button units are arranged according to the first pattern, and the reception insulating base unit includes a plurality of hook-and-loop fasteners or a plurality of button units, and hooks and loops of the plurality of hook-and-loop fasteners are arranged according to a second pattern corresponding to the first pattern, or female and male parts of the plurality of button units are arranged according to the second pattern corresponding to the first pattern.

* * * * *